United States Patent [19]

Phillips

[11] 4,279,086

[45] Jul. 21, 1981

[54] DECORATIVE PANEL AND HANGING DEVICE THEREFOR

[76] Inventor: Orville Phillips, 524 E. 20th St., New York, N.Y. 10009

[21] Appl. No.: 61,848

[22] Filed: Jul. 30, 1979

[51] Int. Cl.[3] ..... G09F 1/12

[52] U.S. Cl. ..... 40/152.1

[58] Field of Search ..... 40/10 D, 10 R, 152, 40/152.1, 614; 248/476, 495, 496, 497

[56] References Cited

U.S. PATENT DOCUMENTS

| | | | |
|---|---|---|---|
| 2,402,717 | 6/1946 | Winer | 248/498 |
| 2,709,056 | 5/1955 | Jacquet | 40/152.1 |
| 2,952,431 | 9/1960 | Pedley | 248/496 |
| 3,501,124 | 3/1970 | Goss | 248/495 |
| 3,945,599 | 3/1976 | Spier et al. | 248/476 |
| 4,171,583 | 10/1979 | Korseman | 40/152 |

*Primary Examiner*—Gene Mancene

*Assistant Examiner*—Wenceslao J. Contreras

*Attorney, Agent, or Firm*—Karl F. Milde, Jr.

[57] ABSTRACT

A decorative panel comprised of a face sheet and a rear sheet arranged one upon the other, each sheet being transparent. The sheets are slightly spaced apart so that a sheet of display material may be held in place by set screws carried by the rear sheet which are not visible from the front of the decorative panel. A first rotatable hanging device is mounted on the outer surface of the rear sheet. The hanging device is capable of being secured against rotation in any desired position. Spaced laterally from the first hanging device is a second hanging device which is also rotatably mounted and can be secured against rotation and is provided with an adjustable hanging strap. Through operation of the rotatable hanging devices, the decorative can be oriented readily in the desired position on a wall surface without requiring extreme accuracy in placing the hooks on the wall.

7 Claims, 6 Drawing Figures

DECORATIVE PANEL AND HANGING DEVICE THEREFOR

BACKGROUND OF THE INVENTION

The present invention is concerned with an improved means for placing decorative panels, including picture frames and the like, on wall surfaces through hanging devices which do not require the use of conventional picture wire and yet provide the means for accurately orienting the device in the desired position without the necessity of exceedingly accurate placement of hanging devices, such as picture hooks, on the wall on which the panel is desired to be mounted.

SUMMARY OF THE INVENTION

The present invention concerns decorative panels or display frames which are mounted on generally vertical walls.

One aspect of the decorative panel of this invention relates to the fact that the panel is comprised of at least two sheets of transparent material such as acrylic plastic. It is desirable to be able to hang the panel accurately in its desired horizontal orientation without the necessity of absolutely accurate placing of the hanging means on the walls. It is thus desirable to be able to accurately orient the panel horizontally without needing the line of sight between the mounting means placed upon the wall to be perfectly horizontal. In addition, it is desirable to be able to hang the decorative panel in any desired orientation without having to reinstall the mounting means on the panel or on the wall.

The present invention accomplishes all of these objectives and also provides an interesting display of a clock and means for orienting display material in a transparent decorative panel without any visible support means.

According to the present invention, the display panel comprises a front and rear sheet of transparent acrylic plastic with a transparent clock face rotatable through 360° with respect to the orientation of the display panel, together with means to rotate the clock mechanism 360° with respect to the display panel.

The present invention also provides a hanging device which is adjustable 360° with respect to the panel and has a hanging strap adjustment built into the device which provides fine lateral adjustment of the hanging means. The display panel of the present invention also provides an improved means for securing display material in the desired display area of the panel.

BRIEF DESCRIPTION OF THE DRAWING

In the accompanying drawing which forms a part of the specification.

ILLUSTRATIVE EMBODIMENTS

The decorative panel and hanging device of this invention is illustrated in the representative embodiments shown in the accompanying drawing.

Figure 1:
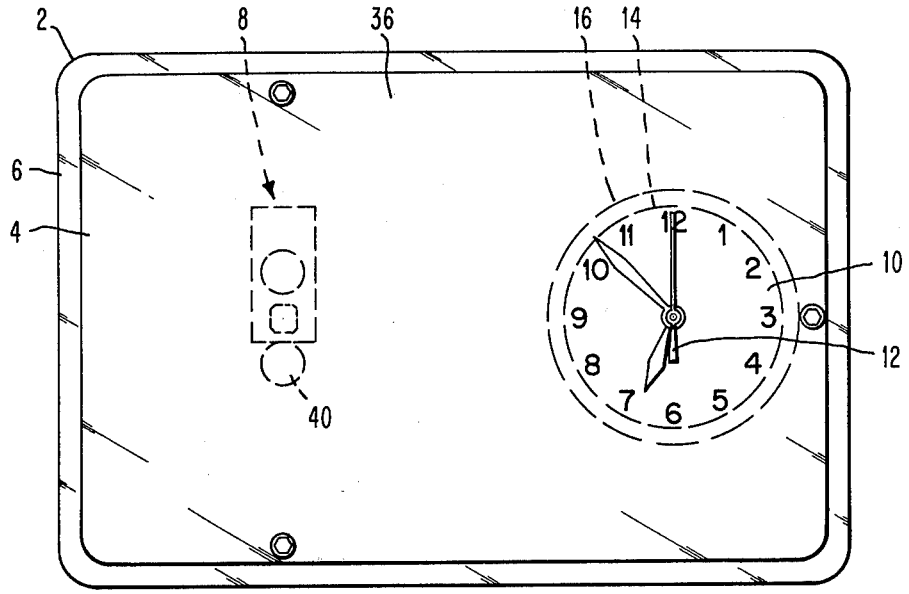
FIG. 1 is a plan view of the front of the decorative panel with the clock and hanger in phantom.
Figure 2:
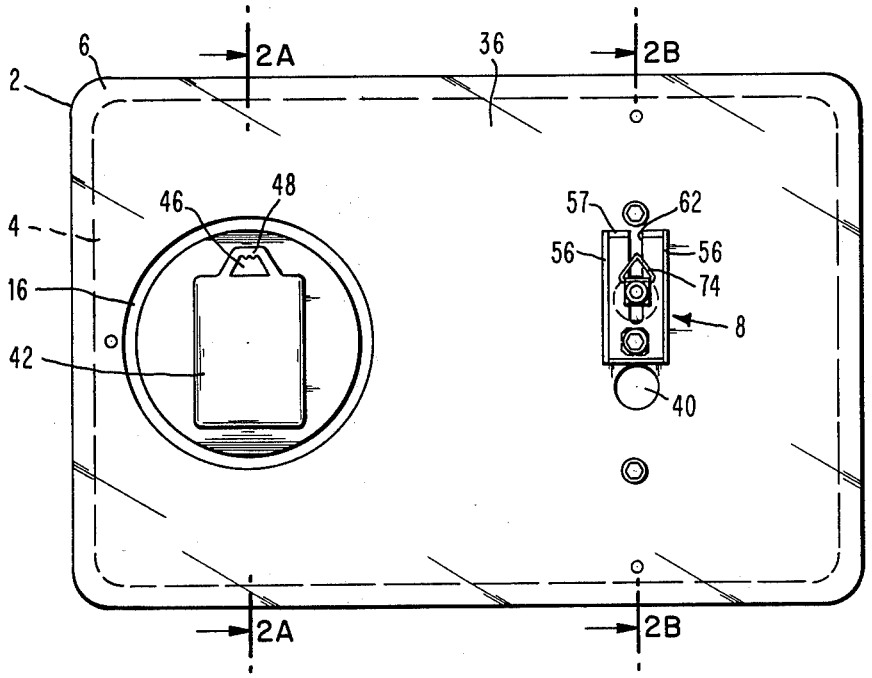
FIG. 2 is a plan view of the back of the decorative panel with a portion of the hanger device in phantom.

Referring to the drawing, particularly FIGS. 1 and 2, the panel is shown in general at 2 and is comprised of a face sheet 4 of clear acrylic plastic and a rear sheet 6 of similar material having slightly larger dimensions than the base sheet 4. The hanger device of the present invention is generally shown at 8, most clearly in FIG. 2 and in phantom in FIG. 1, being mounted on the outside surface of rear sheet 6.

Figure 2A:
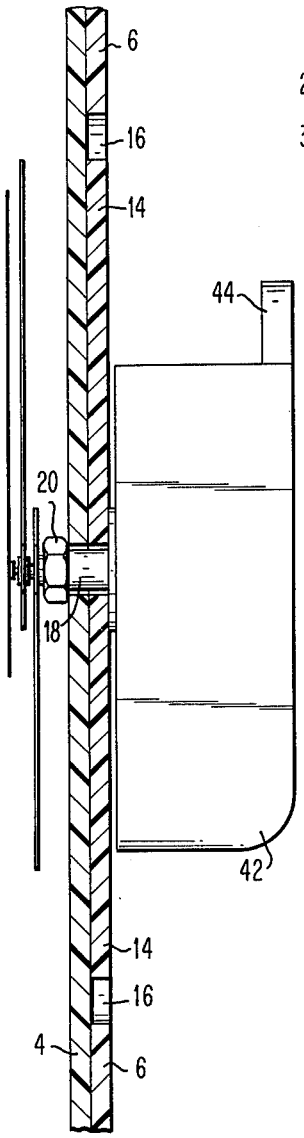
FIG. 2*a* is a partial sectional view along lines 2*a*—2*a* of FIG. 2.
Figure 2B:
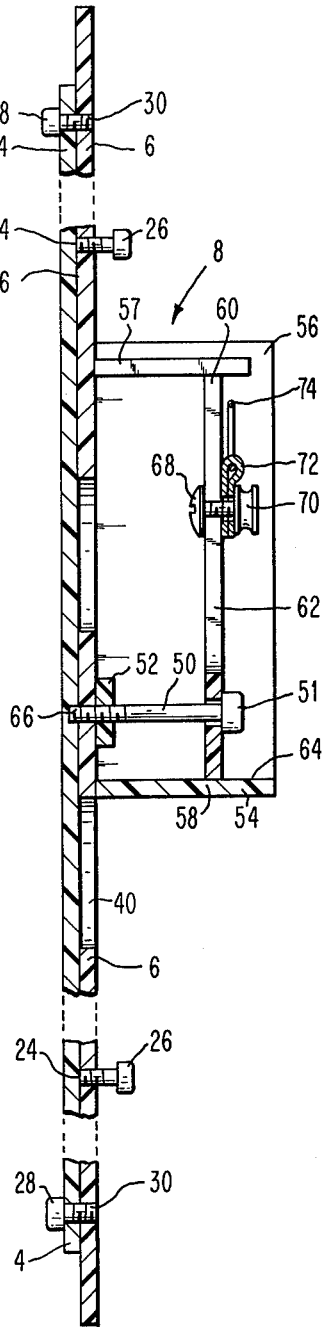
FIG. 2*b* is a partial sectional view along lines 2*b*—2*b* of FIG. 2, the hanger device.

On the decorative panel 2, there is mounted a clock, generally shown at 10, having hands 12 which sweep over the front surface of the face sheet 4 of the decorative panel. The clock face 14 is provided with the usual indicia 15. The clock face 14 is comprised of a circular panel of the same material as the base panel 4 and may be rotated within the circular cutout or aperture 16 in the rear sheet 6. The clock 10 as shown in FIG. 2*a*, has a central shaft 18 which extends throught the rotating face 14 as well as the face sheet 4 and is secured by set nut 20, the adjustment of which permits the clock movement 42 to be rotated with respect to the decorative panel 2 in general and to the rotatable circular clock face 14.

It is intended that relatively thin sheets of paper such as diplomas, photos and other decorative material be retained between the sheets 4 and 6 of the decorative panel 2. These can be set between the sheets 4 and 6 by slipping between the sheets 4 and 6 at the edge 7 of the front sheet 4. The rear sheet 6 is provided with apertures 40 which are located in the intended display area 36 and should be of sufficient size so that a finger or other means can be used to appropriately locate the display material in the display area 36 where it is desired. It is usually desirable to have the edges of the display material spaced inwardly from the edges 7 of the front face sheet 4.

The clockworks are shown in general at 42 and it is understood that another display component besides the clock 10 may be utilized if desired. The clock component 10 is provided with a means for suspending it from a hook or other hanging implement from the wall through means of a loop 48 which is provided with serrations 46 in the usual manner. The panels 4 and 6 are provided with a series of set screws 28 which extend from the front panel 4 through threaded apertures 30 to draw the rear panel 6 against the face panel 4.

The rear panel 6 is provided with set screws 26 and threaded apertures 24 to bear against the rear of the face panel 4, or more properly, the display mat which is to be placed in area 36.

The hanger device 8 is mounted at the rear of the panel 2 by means of the threaded shaft 50 which is secured in the panel in the correspondingly threaded recess 66 which extends through both the face sheet 4, the rear sheet 6 and a reinforcing piece 52 which is secured to the back of the rear sheet 6 by adhesive or other means. The shaft 50 is provided with an end 51 having a screwdriver face therein in order to secure the hanging device 8 against the rear of the panel 2 and to prevent relative rotation of the hanger and with respect to the panel 2. The hanger 8 device is in the shape of a generally hollow rectangular box 54 and has side walls 56, walls 58 and 59, the end 59 having a slot 57 therein. The box 54 has a rear wall 60 extending between the walls, 56, 59 and 60 as provided, at approximately ⅔ of its length with a central slot 62 which is of the same width as the slot 57 and joins it. The slot 62 serves to carry the hanger strap 72 by means of a set screw 68 having a knurled nut 70 at the end of it. The hanger strap 72 is carried by the screw 68 and the loop 74 is mounted on the end of the strap 72.

Figure 3:
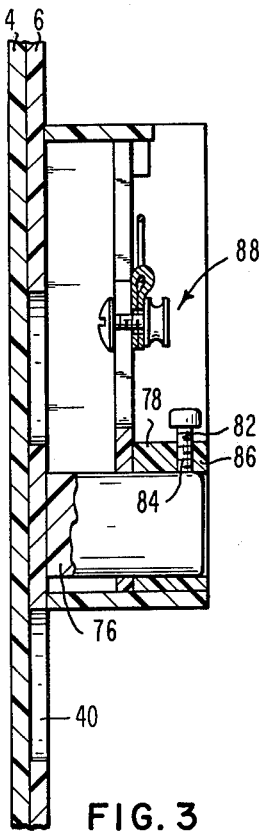
FIG. 3 is a partial sectional view showing an alternative embodiment of the hanger device.
Figure 4:
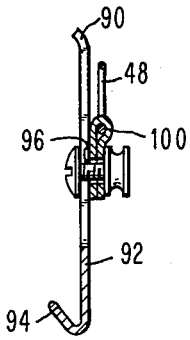
FIG. 4 is a side view partially in section of a hanger device.

Referring to the embodiment shown in FIG. 3, the hanger device 8 is carried on a large stub shaft 76 secured to the rear of the sheet 6. The shaft 76 passes though a corresponding aperture in the block 78 which is an extension of the wall 60. The block 78 has a threaded aperture 82 which retains the set screw 84. In other respects the hanger device 8 is similar to the device in FIG. 2. Shown in FIG. 4 is a hanger clip 90 which comprises the piece 92 having a lower hook 94 and the upper portion is provided with a slot 96 within which slides a shaft with a set screw and nut for adjusting the position of the hanging strap 98 and loop 100 with respect to the member 90.

As indicated above, the present invention provides extremely decorative panels which may be hung on the walls without utilizing picture hanger wire between conventional hooks. In the case of the device 8, it may be oriented in a number of different positions and the hanger device 8 permits the orientation of the hanger device 8 at any angle with respect to the decorative panel and the sliding hanging strap within the slot of the hanging device 8 permits the fine adjustments required to obtain a level orientation of the decorative panel without the necessity of extremely accurate placing of nails or hanging hooks on the wall on which the panel is hung.

It is understood that the above-described arrangements are merely illustrative examples of the application. Numerous other arrangements may be readily devised by those skilled in the art which will embody the principles of the invention and fall within the spirit and scope thereof.

What is claimed is:

1. A decorative panel comprising two transparent sheets, a face sheet and a rear sheet, one upon the other, means for removeably retaining a sheet of display material between said transparent sheets without securing means visibility from the front of said panel, hanging means, a first hanging means rotatable about 360° and extending from the back of said rear sheet, means for securing said first hanging means against rotation at a desired position, and second hanging means spaced from said first hanging means, said second hanging means comprising a device rotatably secured to the rear of said panel, said means for holding said device against rotation in a desired position, adjustable means carried on said device for adjustably moving a hanging strap means in a lateral direction with respect to means rotatably securing said device to the rear of said panel.

2. A hanging device for a decorative panel, adapted to be secured to the rear surface of said panel, comprising means for rotatably mounting said device on the rear surface of said panel, means for holding said device against rotation in a desired position, adjustable means carried on said device for adjustably moving a hanging strap means in a lateral direction with respect to menas for rotatably securing said device to the rear of said panel.

3. A device as claimed in claim 2 wherein said means for rotatably mounting said device comprises a threaded shaft carried on the body of said device and extending into a correspondingly threaded recess on the rear surface of said panel.

4. A device as claimed in claim 2 wherein said means for rotatably mounting said device comprises a cylindrical stub shaft extending from the rear surface of said panel into a corresponding cylindrical aperture in the body of said device, and means carried within said body and capable of bearing against the sides of said shaft to prevent rotation of said device relative to said shaft.

5. A hanger device comprising a generally flat body portion having a first end and a second end, a hook extending outwardly at said first end of said body, a longitudinal slot in said body extending through said body and running from the central portion of said body to, and opening into, the second end of said body, and a hanger strap extending outwardly from the second end of said body and carried on mounting means carried in said slot.

6. A hanger device comprising means for securing the device to a generally flat mounting surface, means for rotating said device about said means for securing the device, a means for suspending an item to be hung from said device, said means for suspending an item being slidably mounted in the device to provide adjustment thereof toward and away from said means for rotating said device and means for fixing said means for suspending an item in the desired position.

7. A device as claimed in claim 6 wherein said means for suspending is rotatably adjustable.

* * * * *